US009177450B2

(12) United States Patent
McBride et al.

(10) Patent No.: US 9,177,450 B2
(45) Date of Patent: Nov. 3, 2015

(54) MEDIA HANDLER PROTECTION

(71) Applicant: NCR Corporation, Duluth, GA (US)

(72) Inventors: Michael McBride, Carnoustie (GB); Charles Harrow, Dundee (GB); Derek Pont, Invergowrie (GB)

(73) Assignee: NCR Corporation, Duluth, GA (US)

( * ) Notice: Subject to any disclaimer, the term of this patent is extended or adjusted under 35 U.S.C. 154(b) by 151 days.

(21) Appl. No.: 13/778,257

(22) Filed: Feb. 27, 2013

(65) Prior Publication Data

US 2014/0239007 A1 Aug. 28, 2014

(51) Int. Cl.
*G07F 19/00* (2006.01)
*G07F 9/06* (2006.01)

(52) U.S. Cl.
CPC ..... *G07F 19/203* (2013.01); *G07F 9/06* (2013.01); *G07F 19/205* (2013.01)

(58) Field of Classification Search
CPC .... G07F 19/00; G06Q 20/1085; G06Q 30/06; G06Q 20/20; G06Q 10/087; G06Q 10/08
USPC ..... 235/379, 383, 385
See application file for complete search history.

(56) References Cited

U.S. PATENT DOCUMENTS 5,136,144 A * 8/1992 Swinton et al. ..... 235/379
2008/0273261 A1* 11/2008 McIntosh et al. ..... 360/92.1

* cited by examiner

*Primary Examiner* — Karl D Frech
(74) *Attorney, Agent, or Firm* — Joseph P. Mehrle

(57) ABSTRACT

The present invention provides a method of preventing unauthorized access into a media item dispenser module. The present invention also provides a media item dispenser module comprising a dispensing slot for presenting at least one media item to a user, and a moveable member moveable between a distal position and a proximal position respectively distal and proximal to the dispensing slot, wherein the moveable member prevents unauthorized access into the media item dispenser module via the dispensing slot when in the proximal position.

15 Claims, 5 Drawing Sheets

MEDIA HANDLER PROTECTION

FIELD OF THE INVENTION

The present invention relates to protecting a media handler from unauthorised access. In particular, but not exclusively, the present invention relates to preventing unauthorised access into a media handler via a media transfer slot of the media handler.

Self-Service Terminals (SSTs) typically include a media handler module for handling items of media responsive to a user transaction. A user transaction may involve depositing a media item and/or retrieving a dispensed media item. A media handler module may accordingly be a media depository, a media dispenser or a media recycler capable of receiving deposited media items from a user and dispensing media items to a user. A media item is typically deposited into and/or dispensed from a media slot of a media handler module.

An SST, such as an Automated Teller Machine (ATM), typically includes a fascia which defines a number of slots for receiving and dispensing media items. The slots may include one or more of the following: a statement output slot, a receipt slot, a card reader slot, a media item dispense slot, and a media item deposit slot. Items of media such as, but not limited to, currency notes, cheques, tickets, giros, stamps, lottery tickets, coupons, vouchers, and the like may be deposited at and/or dispensed from such terminals.

A media handler module also typically includes at least one media item container which store media items. When the media item is a currency note, a currency cassette may be used as a media item container. It is known for unauthorised users to maliciously attempt to access stored media items via a media slot. Such malicious behaviour includes introducing an object or tool into a media slot, such as an explosive solid, a tube to introduce explosive gas, or a cash trap device, or the like.

Known media handlers often have a shutter for closing relatively large slots, whilst smaller slots have no protection at all to unauthorised access. However, unauthorised access past such a shutter has been observed.

It is also known for SSTs, such as ATMs, to include an ink deployment system which is activated when a malicious attack is sensed. Such a system attempts to stain stored currency notes, for example, with an ink in case the notes are stolen. However, such systems are unable to distribute ink to the currency notes faster than the explosion occurs.

Known media handlers are therefore vulnerable to explosive attack and/or unauthorised access and are unable to detect/prevent such an attack in time.

SUMMARY OF THE INVENTION

It is an aim of the present invention to at least partly mitigate the above-mentioned problems.

It is an aim of certain embodiments of the present invention to prevent unauthorised access to media items stored in a media handler via a dispensing slot of the media handler.

It is an aim of certain embodiments of the present invention to detect unauthorised access into a media handler via a dispensing slot of the media handler.

It is an aim of certain embodiments of the present invention to detect unauthorised access into a media handler via a dispensing slot of the media handler and provide a warning flag to an ink deployment and/or alarm system of the media handler.

According to a first aspect of the present invention there is provided a media item dispenser module comprising:

a dispensing slot for presenting at least one media item to a user; and a moveable member moveable between a distal position and a proximal position respectively distal and proximal to the dispensing slot, wherein the moveable member prevents unauthorised access into the media item dispenser module via the dispensing slot when in the proximal position.

It is an aim of certain embodiments of the present invention to help protect a vulnerable region of an SST using parts of an SST that are useable for other purposes.

Aptly, the moveable member is located in the proximal position when the media item dispenser module is in a dormant state to thereby protect the media item dispenser module from unauthorised access via the dispensing slot between media item transactions.

Aptly, the moveable member comprises a support surface for supporting at least one media item and locating at least one supported media item at the dispensing slot.

Aptly, the moveable member comprises a carriage moveable along a transport path for transporting media items towards the dispensing slot.

Aptly, the transport path is defined by at least one transport track.

Aptly, the media item dispenser module further comprises at least one sensor for sensing an unauthorised movement of the moveable member from the dispensing slot towards the distal position.

Aptly, the at least one sensor comprises one or more of a motion sensor, a pressure sensor, a force transducer, an accelerometer, a switch and an optical sensor, or the like.

Aptly, the media item dispenser module further comprises at least one actuator for selectively moving the moveable member between the distal and proximal positions.

Aptly, the at least one actuator is responsive to the at least one sensor and configured to resist the unauthorised movement when sensed.

Aptly, the at least one actuator is adapted to urge the moveable member towards the dispensing slot when the unauthorised movement is sensed.

Aptly, the at least one actuator comprises a motor.

Aptly, the media item dispenser module further comprises at least one media item staining device for selectively deploying a stain onto stored media items, wherein the at least one media item staining device is configured to receive a signal from the at least one sensor when the unauthorised movement is sensed.

Aptly, the media item dispenser module further comprises at least one alarm device configured to receive a signal from the at least one sensor when the unauthorised movement is sensed.

According to a second aspect of the present invention there is provided a Self-Service Terminal (SST) comprising a media item dispenser module, wherein the media item dispenser module comprises:

a dispensing slot for presenting at least one media item to a user; and a moveable member moveable between a distal position and a proximal position respectively distal and proximal to the dispensing slot, wherein the moveable member prevents unauthorised access into the media item dispenser module via the dispensing slot when in the proximal position.

According to a third aspect of the present invention there is provided a method of presenting at least one media item to a user, comprising:

locating a moveable member at a dispensing slot of a media item dispenser module to prevent unauthorised access into the module via the dispensing slot, wherein at least one media item is presentable at the dispensing slot to a user;

moving the moveable member away from the dispensing slot along a path to a distal location relative to the dispensing slot;

delivering at least one media item onto the moveable member at the distal location in response to a user transaction; and moving the moveable member from the distal position towards the dispensing slot to thereby present the at least one media item to a user.

Aptly, the moveable member is located at the dispensing slot when the media item dispenser module is in a dormant state to thereby protect the media item dispenser module from unauthorised access via the dispensing slot between media item transactions.

Aptly, the method further comprises sensing an unauthorised movement of the moveable member in a direction from the dispensing slot towards the distal position.

Aptly, the method further comprises resisting the unauthorised movement when sensed.

Aptly, the method further comprises urging the moveable member towards the dispensing slot when the unauthorised movement is sensed.

Aptly, the method further comprises providing a signal to a media item staining device when the unauthorised movement is sensed.

Aptly, the method further comprises providing a signal to an alarm device when the unauthorised movement is sensed.

According to a fourth aspect of the present invention there is provided a method of preventing unauthorised access into a media item dispenser module, comprising:

locating a moveable member at a dispensing slot of a media item dispenser module to prevent unauthorised access into the media item dispenser module via the dispensing slot, wherein at least one media item is presentable at the dispensing slot to a user;

sensing an unauthorised movement of the moveable member in a direction away from the dispensing slot; and urging the moveable member towards the dispensing slot to resist the unauthorised movement.

Aptly, the method further comprises providing a signal to a media item staining device when the unauthorised movement is sensed.

Aptly, the method further comprises providing a signal to an alarm device when the unauthorised movement is sensed.

According to a fifth aspect of the present invention there is provided a method of preventing unauthorised access into a media item dispenser module, comprising:

locating a carriage at a dispensing slot of a media item dispenser module to prevent unauthorised access into the media item dispenser module via the dispensing slot.

According to a sixth aspect of the present invention there is provided a method of detecting unauthorised access into a media item dispenser, the method comprising:

moving a carriage to block a dispensing slot in the media item dispenser; and detecting unauthorized movement of the carriage away from the dispensing slot.

According to a seventh aspect of the present invention there is provided a method of detecting unauthorised access into a media handler, the method comprising:

moving a carriage to block a media transfer slot in the media handler; and detecting unauthorized movement of the carriage away from the media transfer slot.

Aptly, the media handler may be a media recycler, a media depository or a media dispenser, and the media transfer slot may be a media input/output slot, a media input slot or a media output slot, respectively.

Certain embodiments of the present invention provide the advantage that a media handler is protected from unauthorised access into the media handler via a dispensing slot of the media handler.

Certain embodiments of the present invention provide the advantage that unauthorised access into a media handler via a dispensing slot of the media handler is prevented.

Certain embodiments of the present invention provide the advantage that unauthorised access into a media handler via a dispensing slot of the media handler is detectable.

Certain embodiments of the present invention provide the advantage that unauthorised access into a media handler via a dispensing slot of the media handler may detected early and a warning flag may be sent to an ink deployment and/or alarm system of the media handler.

BRIEF DESCRIPTION OF DRAWINGS

Embodiments of the present invention will now be described hereinafter, by way of example only, with reference to the accompanying drawings in which.

DESCRIPTION OF EMBODIMENTS

Figure 1A:
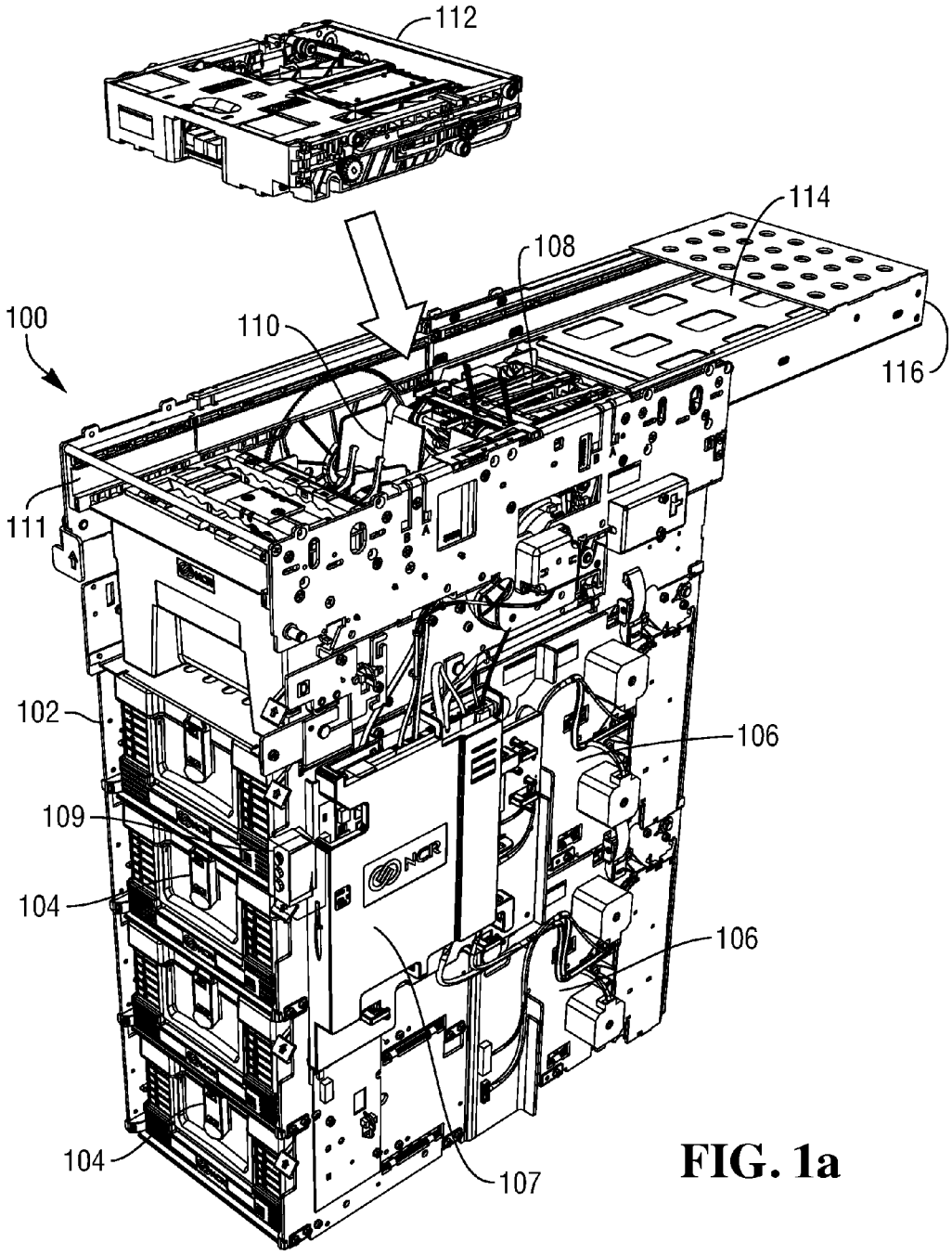
FIG. 1*a* illustrates a rear access media presenter according to an embodiment of the present invention.

In the drawings like reference numerals refer to like parts.

FIG. 1*a* illustrates a rear access media item presenter 100 (in the form of a banknote presenter) according to an embodiment of the present invention. The banknote presenter 100 includes a chassis 102 which supports a number of currency cassettes 104 for storing bank notes of different value. Respective pick units 106 remove individual stored bank notes from respective currency cassettes 104 responsive to a user transaction. A transport unit 108 coupled with the pick units 106 delivers at least one bank note to a stacker unit 110 which aligns and collates picked bank notes. A control board 107 and status indicator lights 109 are also supported by the chassis 102. The collated bank notes are delivered on to a carriage 112 which is moveable along a transport path from a default stacking position to a presentation position. The carriage 112 is supported by a transport track 111 and moved along the transport path from the default stacking position to a nose 114 of the media item presenter 100. The nose 114 has an open end defining a dispensing slot 116 from which currency notes are presented to a user. The dispensing slot 116 aligns with an opening in a fascia (not shown) of a Self-Service Terminal (SST).

Figure 1B:
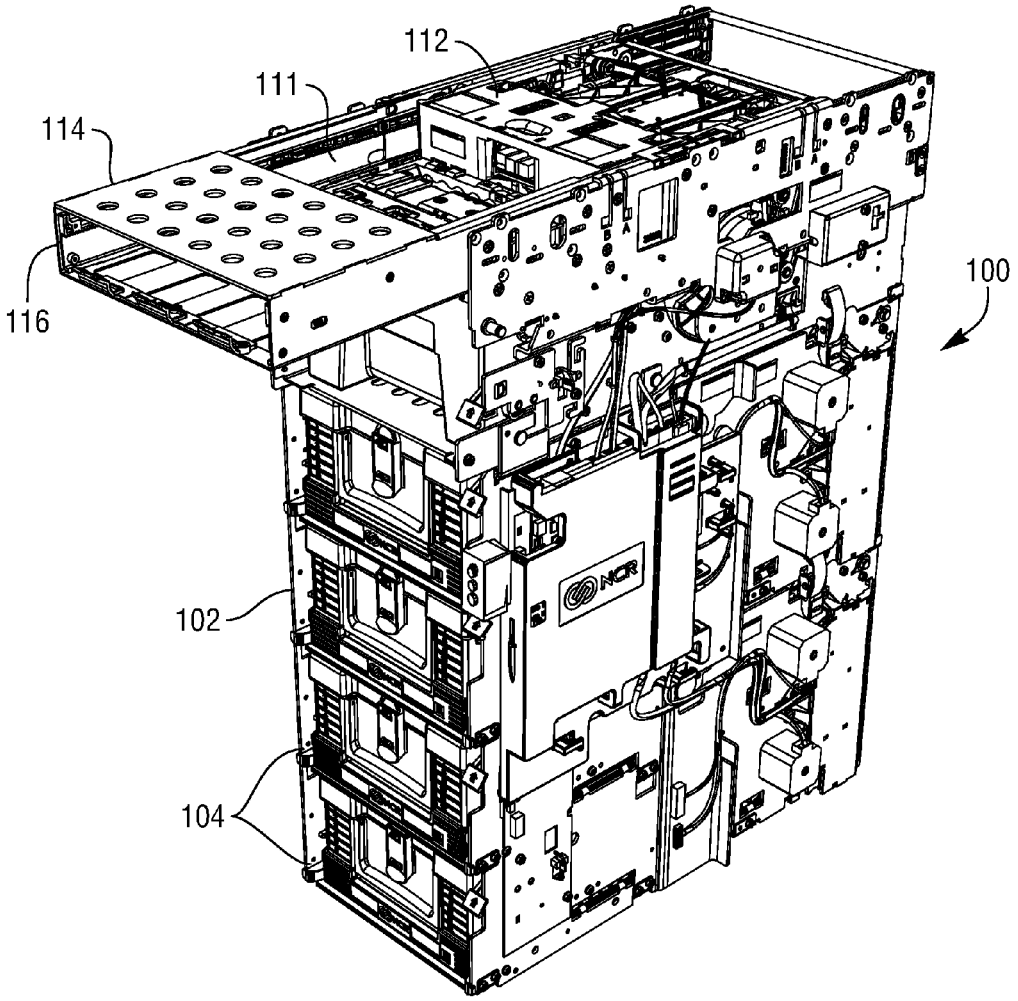
FIG. 1*b* illustrates a front access media presenter according to an embodiment of the present invention.

FIG. 1*b* illustrates a front access variant of the banknote presenter 100 as shown in FIG. 1*a*. The nose 114 is removable from the chassis 102 and may be located on the same or opposing end of the banknote presenter 100 relative to the currency cassettes 104, in response to whether a front access or rear access presenter 100 is desired. It is the location of the currency cassettes 104 relative to the nose 114 and dispensing slot 116 which determines whether a banknote presenter 100 is a front or rear access variant. For example, the currency cassettes 104 of the presenter 100 in FIG. 1*a* are located on an opposing side of the presenter 100 relative to the nose 114 and dispensing slot 116, thereby defining it as a rear access variant. In contrast, the currency cassettes 104 of the presenter 100 in FIG. 1*b* are located on the same side of the presenter 100 as the nose 114 and dispensing slot 116, thereby defining it as a front access variant.

Figure 2A:
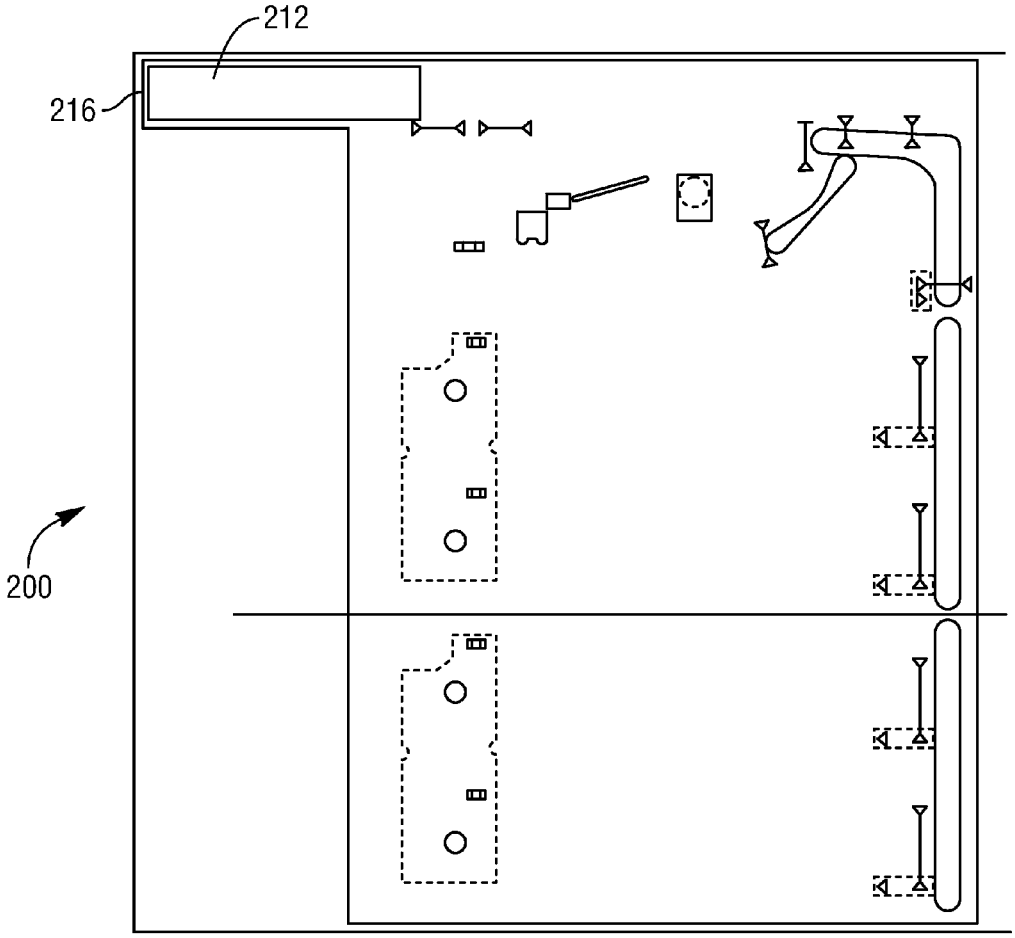
FIG. 2*a* illustrates a simplified schematic of a front access media presenter according to an embodiment of the present invention wherein the carriage is located at a dispensing slot of the presenter.

FIG. 2*a* illustrates a front access banknote presenter 200 according to an embodiment of the present invention wherein the carriage 212 is located at the presentation position when the presenter is in a dormant state. The carriage 212 acts to block the dispensing slot 216 and prevent unauthorised access into the presenter 200 via the dispensing slot 216 between media item transactions. It will be understood that a media item presenter, such as a banknote presenter 200, is in active state whilst performing a user transaction and in a dormant state between user transactions, i.e. whilst waiting for a further user to use the media item presenter.

Figure 2B:
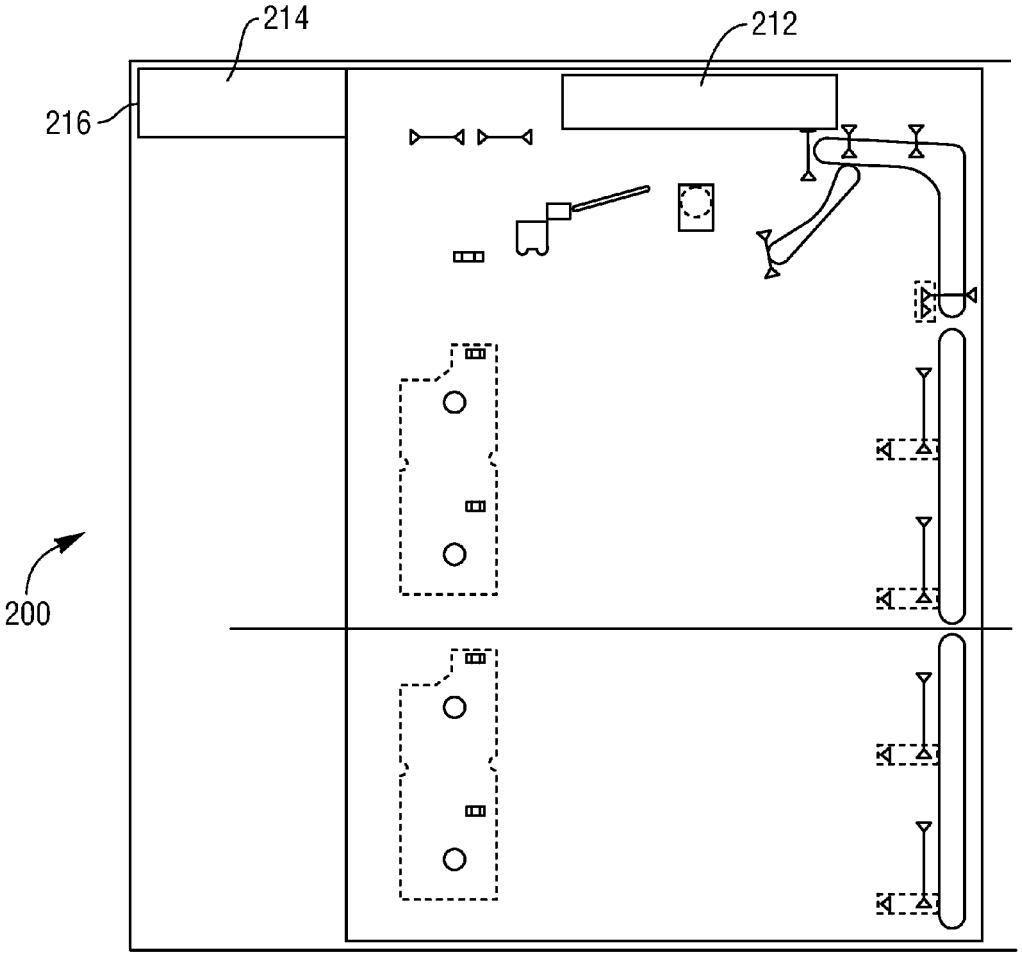
FIG. 2*b* illustrates a simplified schematic of the media presenter of FIG. 3*a* wherein the carriage is located at a stacking position.

As illustrated in FIG. 2*b*, the carriage 212 is moved from the presentation position to the stacking position in response to a user transaction for picked and collated banknotes to be delivered on to the carriage 212. The carriage 212 is then moved along the transport path to return to the presentation position at the dispensing slot 216 for a user to retrieve the presented banknotes. The carriage 212 remains in the presentation position until a further user transaction is input to ensure the dispensing slot 216 remains protected from unauthorised access whilst the banknote presenter is in a dormant state.

In a similar manner, where the media handler is a media depository, for example, the carriage 212 'rests' in the presentation position whilst protecting the dispensing slot 216 from unauthorised access. After a user deposits media items, such as banknotes, onto or into the carriage 212 at the dispensing slot 216, the carriage 212 is moved along the transport path to the stacking position for the media items to be removed from the carriage 212 and delivered to respective media item containers or cassettes 204.

Figure 2C:
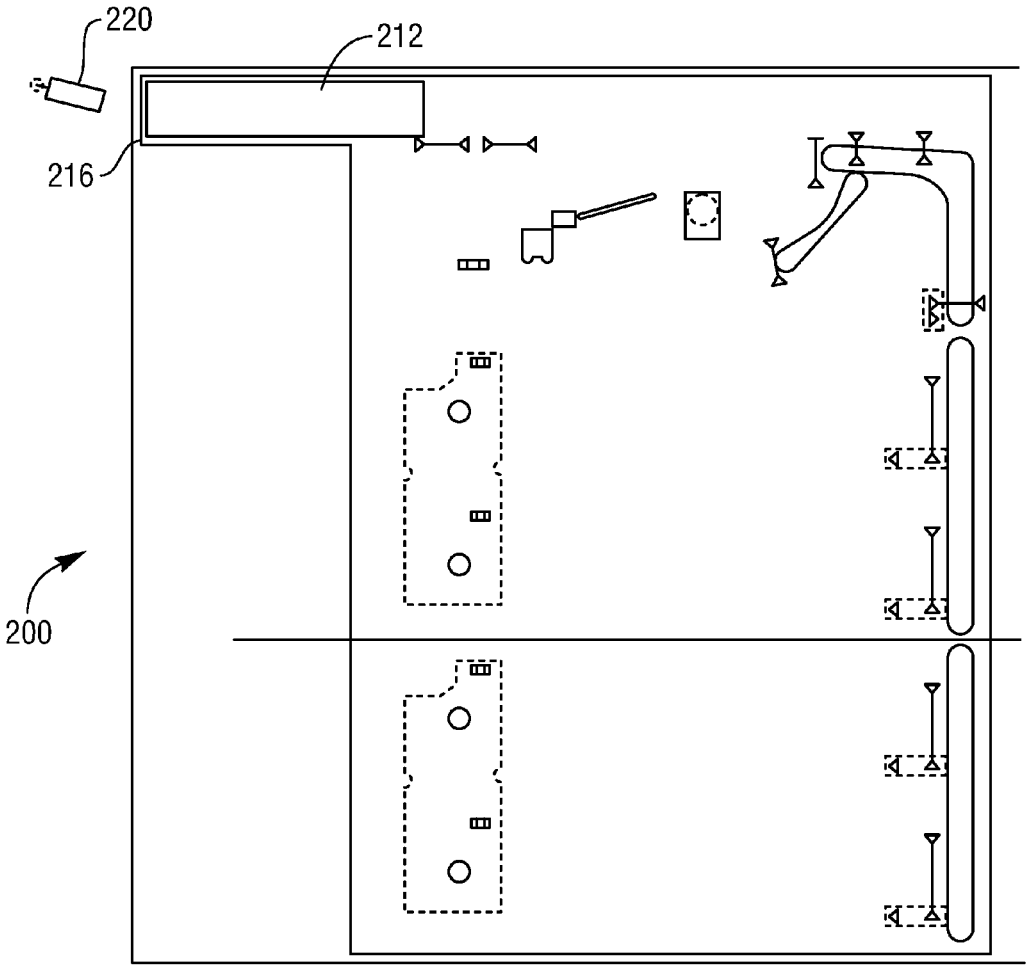
FIG. 2*c* illustrates a simplified schematic of the media presenter of FIG. 3*a* wherein the carriage is detecting/preventing unauthorised access of a foreign object into the media presenter via the dispensing slot.

FIG. 2*c* illustrates the carriage 212 in the presentation position blocking the dispensing slot 216. An attempt to force a foreign object 220, such as an explosive solid, into the banknote presenter 200 via the dispensing slot 216 will cause the carriage 212 to move along the transport path towards the stacking position. A sensor (not shown) is configured to detect such unauthorised movement and to communicate with the controller (not shown) in response to said unauthorised movement. The controller may operate an actuator, such as a motor, which drives the carriage 212 along the transport path to cause the carriage 212 to resist the unauthorised movement or to move the carriage towards the presentation position to thereby eject the foreign object 220 from the dispensing slot before authorised access is possible. In addition or alternatively, the controller may provide a warning flag to a banknote staining device (not shown), such as an ink deployment device, of the banknote presenter 200 to thereby provide advance warning of an unauthorised access. In addition or alternatively, the controller may provide a warning flag to an audible/visual alarm system.

It will be understood that certain embodiments of the present invention described herein are applicable to any media handler having an opening for dispensing/depositing media items. Such a media handler may be a media dispenser, media depository or a media item recycler. Items of media may include one or more of the following: currency notes, cheques, tickets, giros, stamps, lottery tickets, coupons, vouchers, or the like.

Throughout the description and claims of this specification, the words "comprise" and "contain" and variations of them mean "including but not limited to" and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of the features and/or steps are mutually exclusive. The invention is not restricted to any details of any foregoing embodiments. The invention extends to any novel one, or novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

What is claimed is:

1. A media item dispenser module comprising:

a dispensing slot for presenting at least one media item to a user, wherein the dispensing slot adapted to present the at least one media item as one of: a currency note, a check, a ticket, a giro, a stamp, a lottery ticket, a coupon, and a voucher; and a moveable member moveable between a distal position and a proximal position respectively distal and proximal to the dispensing slot, wherein the moveable member prevents unauthorised access into the media item dispenser module via the dispensing slot when in the proximal position, and wherein the moveable member further adapted to move from the proximal position to the distal position upon detection of a foreign object that attempting to be forced into the dispensing slot.

2. The media item dispenser module as claimed in claim 1, wherein the moveable member is located in the proximal position when the media item dispenser module is in a dormant state to thereby protect the media item dispenser module from unauthorised access via the dispensing slot between media item transactions.

3. The media item dispenser module as claimed in claim 1, wherein the moveable member comprises a carriage moveable along a transport path for transporting media items towards the dispensing slot.

4. The media item dispenser module as claimed in claim 1, further comprising at least one sensor for sensing an unauthorised movement of the moveable member from the dispensing slot towards the distal position.

5. The media item dispenser module as claimed in claim 1, further comprising at least one actuator for selectively moving the moveable member between the distal and proximal positions.

6. The media item dispenser module as claimed in claim 5, wherein the at least one actuator is adapted to urge the moveable member towards the dispensing slot in response to at least one sensor for sensing an unauthorised movement of the moveable member from the dispensing slot towards the distal position.

7. The media item dispenser module as claimed in claim 1, further comprising at least one media item staining device for selectively deploying a stain onto stored media items, wherein the at least one media item staining device is configured to receive a signal responsive to an unauthorised movement of the moveable member from the dispensing slot towards the distal position which is sensed by at least one sensor.

8. The media item dispenser module as claimed in claim 1, further comprising at least one alarm device configured to receive a signal responsive to an unauthorised movement of the moveable member from the dispensing slot towards the distal position which is sensed by at least one sensor.

9. A Self-Service Terminal (SST) comprising a media item dispenser module as claimed in claim 1.

10. A method of presenting at least one media item to a user, comprising:

locating a moveable member at a dispensing slot of a media item dispenser module to prevent unauthorised access into the module via the dispensing slot, wherein at least one media item is presentable at the dispensing slot to a user, and wherein the at least one media item is presentable at the dispensing slot to the user as one of: a currency note, a check, a ticket, a giro, a stamp, a lottery ticket, a coupon, and a voucher;

moving the moveable member away from the dispensing slot along a path to a distal location relative to the dispensing slot;

delivering at least one media item onto the moveable member at the distal location in response to a user transaction;

moving the moveable member from the distal position towards the dispensing slot to thereby present the at least one media item to a user; and moving the moveable member from away from the dispensing slot in response to an attempt to force a foreign object into the dispensing slot.

11. The method as claimed in claim 10, further comprising sensing an unauthorized movement of the moveable member in a direction from the dispensing slot towards the distal position.

12. The method as claimed in claim 10, further comprising urging the moveable member towards the dispensing slot when the unauthorised movement is sensed.

13. A method of preventing unauthorised access into a media item dispenser module, comprising:

locating a moveable member at a dispensing slot of a media item dispenser module to prevent unauthorised access into the media item dispenser module via the dispensing slot, wherein at least one media item is presentable at the dispensing slot to a user, and wherein the at least one media item is presentable at the dispensing slot to the user as one of: a currency note, a check, a ticket, a giro, a stamp, a lottery ticket, a coupon, and a voucher;

sensing an unauthorised movement of the moveable member in a direction away from the dispensing slot;

urging the moveable member towards the dispensing slot to resist the unauthorised movement; and sensing when an attempt is made to force a foreign object into the dispensing slot and in response thereto urging the moveable member away from the dispensing slot.

14. The method as claimed in claim 13, further comprising providing a signal to a media item staining device and/or alarm device when the unauthorized movement is sensed.

15. A method of preventing unauthorised access into a media item dispenser module, comprising:

locating a carriage at a dispensing slot of a media item dispenser module to prevent unauthorised access into the media item dispenser module via the dispensing slot;

presenting, by the media item dispenser module at least one media item associated with authorized access into the media time dispenser module, wherein the at least one media item is presented as one of: a currency note, a check, a ticket, a giro, a stamp, a lottery ticket, a coupon, and a voucher; and moving the carriage away from the dispensing slot to a stacking position within the media item dispenser module when an attempt is detected to force a foreign object into the dispenser module.

* * * * *